US012324466B2

(12) United States Patent
Blackburn et al.

(10) Patent No.: US 12,324,466 B2
(45) Date of Patent: Jun. 10, 2025

(54) PROTECTIVE MASKS AND METHODS OF MANUFACTURE

(71) Applicant: ECOSHIELD MASKS, LLC, West Chester, OH (US)

(72) Inventors: Floyd D. Blackburn, Florence, KY (US); Lisa M. Scola, Orange, CA (US)

(73) Assignee: Ecoshield Masks, LLC, West Chester, OH (US)

( * ) Notice: Subject to any disclaimer, the term of this patent is extended or adjusted under 35 U.S.C. 154(b) by 83 days.

(21) Appl. No.: 17/358,092

(22) Filed: Jun. 25, 2021

(65) Prior Publication Data

US 2022/0079270 A1 Mar. 17, 2022

Related U.S. Application Data

(60) Provisional application No. 63/044,674, filed on Jun. 26, 2020.

(51) Int. Cl.
*A41D 13/11* (2006.01)
*A41D 31/18* (2019.01)

(52) U.S. Cl.
CPC ..... *A41D 13/1161* (2013.01); *A41D 13/11* (2013.01); *A41D 13/1107* (2013.01); *A41D 31/18* (2019.02); *A41D 2400/38* (2013.01)

(58) Field of Classification Search
CPC ..... A41D 13/1161; A41D 31/18; A41D 2400/38; A41D 13/11–1192; A62B 23/00; A62B 23/02; A62B 23/025; A62B 18/00; A62B 18/025; A62B 18/02; A61M 16/06; A61M 16/0605; A61M 16/0661
USPC ..... 128/846, 857, 858, 863, 206.12, 206.16, 128/206.18, 207.17
See application file for complete search history.

(56) References Cited

U.S. PATENT DOCUMENTS

2003/0145858 A1* 8/2003 Cardarelli ..... A61F 9/045 128/206.22
2003/0217751 A1* 11/2003 Patrick ..... A62B 18/084 128/205.27
2012/0199142 A1* 8/2012 Nagao ..... A41D 13/1115 128/863
2013/0186414 A1* 7/2013 Suzuki ..... A41D 13/1161 128/863

(Continued)

FOREIGN PATENT DOCUMENTS

CN 101284165 A * 10/2008 ..... A62B 9/06
CN 106108177 A * 11/2016 ..... A41D 13/11

(Continued)

OTHER PUBLICATIONS

Translation of DE-202020101781-U1 (Year: 2020).*

(Continued)

*Primary Examiner* — Rachael E Bredefeld
*Assistant Examiner* — Seth R. Brown
(74) *Attorney, Agent, or Firm* — Dinsmore & Shohl LLP

(57) ABSTRACT

Protective masks and methods of manufacture, the protective masks including a front cover portion configured to face away from a face of a user in a tied configuration, a rear cover portion configured to face toward the face of the user in the tied configuration, a nose pocket disposed between the front cover portion and the rear cover portion, and a nosebridge disposed within the nose pocket.

19 Claims, 10 Drawing Sheets

(56) References Cited

U.S. PATENT DOCUMENTS

| | | | | |
|---|---|---|---|---|
| 2013/0291272 | A1* | 11/2013 | Bourque | A41D 13/1161 2/9 |
| 2016/0151650 | A1* | 6/2016 | Reese | A41D 13/1161 128/863 |
| 2017/0318875 | A1* | 11/2017 | Henderson | A62B 23/025 |
| 2018/0160749 | A1* | 6/2018 | Kim | A41D 13/1107 |
| 2018/0264294 | A1* | 9/2018 | Hancock | A41D 13/1138 |
| 2018/0353782 | A1* | 12/2018 | Vasiliev | A62B 23/025 |
| 2022/0134138 | A1* | 5/2022 | Cheng | A62B 18/025 128/863 |

FOREIGN PATENT DOCUMENTS

| | | | | |
|---|---|---|---|---|
| DE | 202020101781 | U1 * | 6/2020 | A41D 13/11 |
| KR | 20090003481 | U * | 4/2009 | A62B 18/02 |
| KR | 20180061732 | A * | 6/2018 | A41D 13/1161 |
| TW | M596090 | U * | 6/2020 | A62B 9/06 |

OTHER PUBLICATIONS

Translation of CN-101284165-A (Year: 2008).*
Translation of KR-20180061732-A (Year: 2018).*
Translation of TW-M596090-U (Year: 2020).*
Translation of KR-20090003481-U (Year: 2009).*
Translation of CN-106108177-A (Year: 2016).*

* cited by examiner

PROTECTIVE MASKS AND METHODS OF MANUFACTURE

CROSS-REFERENCE TO RELATED APPLICATIONS

The present disclosure claims the benefit of U.S. Prov. App. No. 63/044,674 filed Jun. 26, 2020, the entirety of which is incorporated by reference herein.

TECHNICAL FIELD

The present specification generally relates to masks, and, more specifically, to protective masks to protect against virus and/or other contagion transmission (e.g., via mold, bacteria, smoke, and/or sun transmission) and methods of manufacture of such masks.

BACKGROUND

Protective masks may be used by medical professionals and other people to protect against transmission of contagions such as a virus transmitted through air particulates. For example, a person sneezing or coughing may transmit the contagion to another nearby person. The protective masks protect against such a transmission. However, the protective masks may cause fogging of eyewear, reduction in breathability of a person, and/or may not provide a comfortable fit.

Accordingly, a need exists for alternative masks to protect against virus and/or other contagion or other transmission to reduce fogging, improve breathability, and provide a comfortable fit, and manufacture and use of such masks.

SUMMARY

In one embodiment according to the subject matter of the present disclosure, a protective mask may include a front cover portion configured to face away from a face of a user in a tied configuration, a rear cover portion configured to face toward the face of the user in the tied configuration, a nose pocket disposed between the front cover portion and the rear cover portion, and a nosebridge disposed within the nose pocket.

In another embodiment, a protective mask may include a front cover portion configured to face away from a face of a user in a tied configuration, a rear cover portion configured to face toward the face of the user in the tied configuration, a nose pocket disposed between the front cover portion and the rear cover portion, a nosebridge disposed within the nose pocket, a protective strip, wherein the protective strip is configured to be disposed on the rear cover portion along a length of the nosebridge disposed within the nose pocket, and at least one tie portion configured to tie the protective mask to the face of the user in the tied configuration.

In yet another embodiment, a method of manufacturing a protective mask may include preparing a nose pocket disposed between a front cover portion and a rear cover portion of the protective mask, and disposing a nosebridge within the nose pocket.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
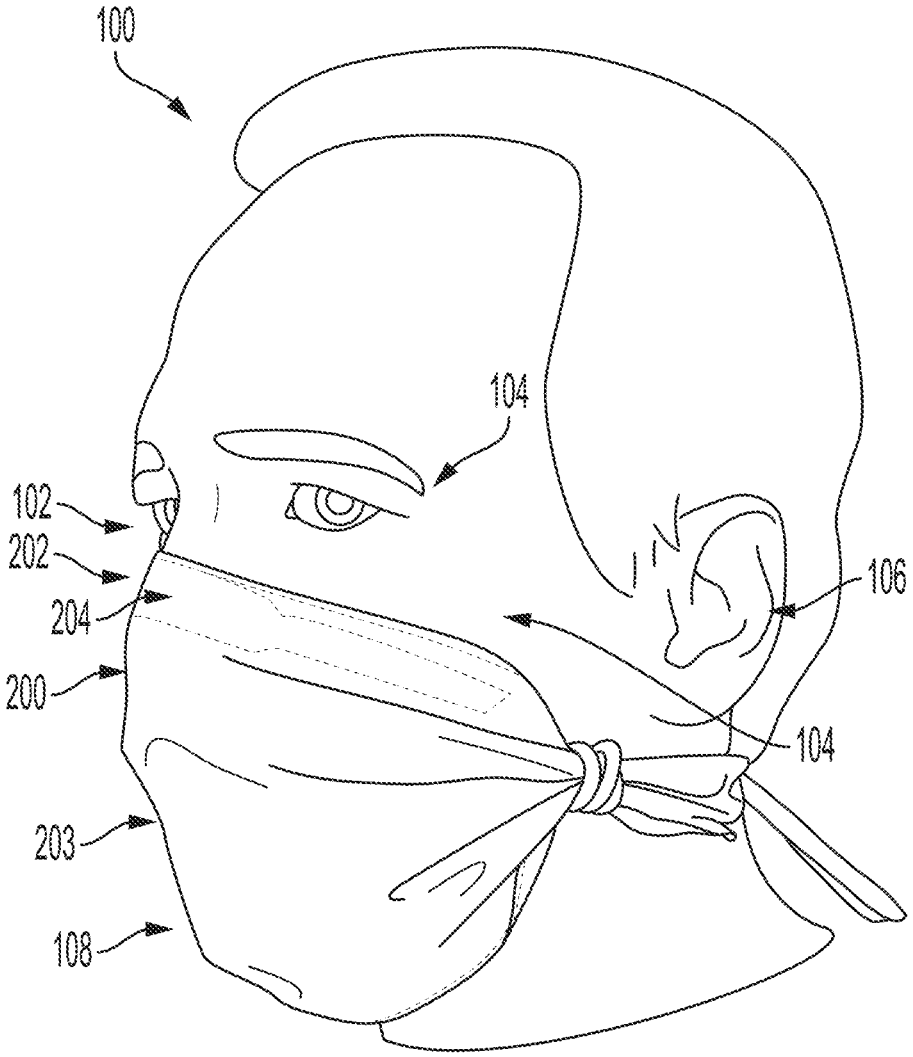
FIG. 1 schematically illustrates a perspective view of a person wearing a protective mask in a tied configuration (including but not limited to toggle, VELCRO, snaps, other fastening mechanisms, and the like), according to one or more embodiments shown and described herein.

Reference will now be made in detail to embodiments of protective masks, examples of which are illustrated in the accompanying drawings. Whenever possible, the same reference numerals will be used throughout the drawings to refer to the same or like parts. Various embodiments of protective masks will be described in further detail herein with specific reference to the appended drawings. It us to be understood and within the scope of this disclosure that the masks described herein are operable as face coverings for a multitude of uses and for one or more users in a variety of environments ranging from, and not limited to, general purpose environments, commercial environments, and/or medical environments. Any numerical dimensions described herein are non-limiting examples.

Protective masks used by medical professionals, first responders, and other people to protect those wearing the masks and/or others around the mask wearers against transmission of contagions (further including, but not limited to, and other harmful particulate matter such as bacteria, mold, smoke, and dust) such as a virus transmitted through air particulates are desired by those seeking such protection. For example, a person sneezing or coughing may transmit the contagion to another nearby person, and a protective mask may protect against such a transmission. Such masks may be referred to as personal protective equipment ("PPE") worn by users to minimize exposure to hazards such as airborne particles that may cause illness. N95 masks are examples of such masks and PPE that act as a particulate-filtering face mask respirator to filter at least 95% of airborne particles.

The protective masks such as those described in embodiments herein protect against such a transmission in a manner that prevents fogging of eyewear of the person wearing the mask, improves breathability of the person through adjustable and sealable features, and/or provides a customizable comfortable fit for the user as the person wearing the protective mask as a breathable filtration device. The protective masks described herein may further be configured to convert from mask design to other fashion accessory design in a non-mask configuration, such as a headband or neck scarf, in a sporty, indoors or outdoors oriented configuration. The protective masks described herein are configured to provide a breathable and reusable face covering providing filtration protection for user's against contagions such as viral and allergen contagions as airborne particles a user wishes to filter out when breathing in oxygen. In embodiments, the covering may be made of a 1900 series filtration material that is allergy and asthma friendly.

FIG. 1 generally depicts an embodiment of a person 100 including a face of a person. The face includes a nose 102, eyes 104, ears 106, and chin 108. A protective mask 200 is disposed in a tied configuration over a portion of the face of the person 100, including portions of the nose 102 and chin 108 in FIG. 1 and which may also be around the neck of the person. It is to be understood that other portions of the face of the person 100 may be covered by the protective mask 200 in a tied configuration.

Figure 2:
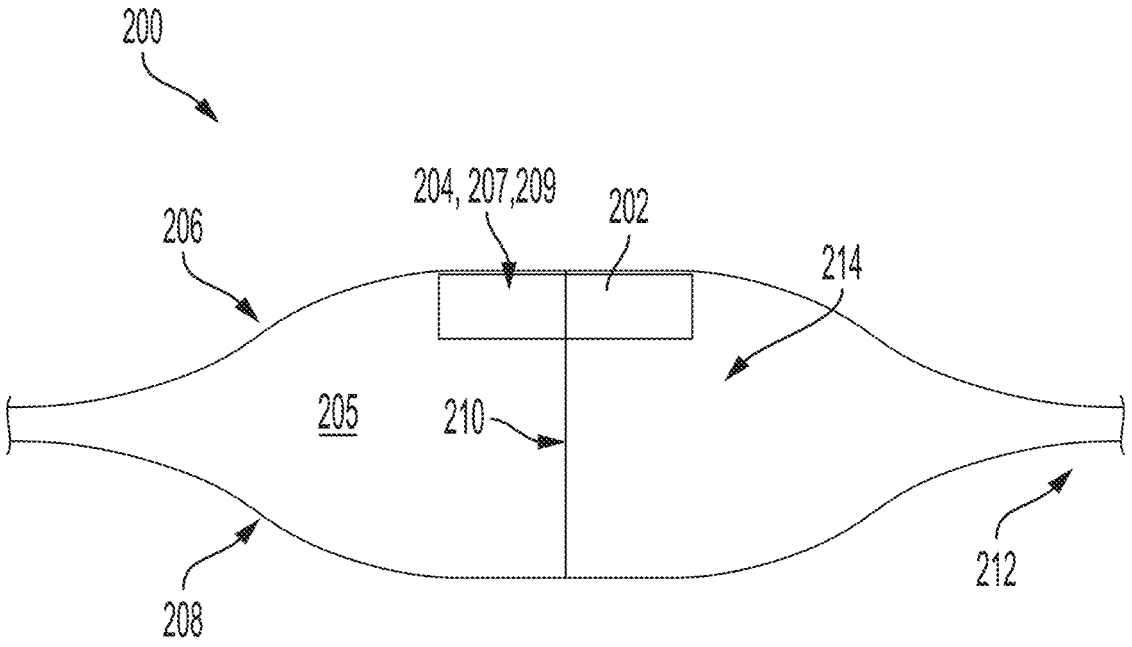
FIG. 2 schematically illustrates a rear view of the protective mask of FIG. 1 in an open and loose configuration (which may also be semi-opened in a gathered configuration), according to one or more embodiments shown and described herein.

Referring to FIGS. 1-2, the protective mask 200 includes a front cover portion 203 (FIG. 1) and a rear cover portion 205 (FIG. 2). In embodiments, the front cover portion 203 and the rear cover portion 205 may include a front and rear of a single layer or of a plurality of layers of one or more connected materials. As shown in FIG. 1, the front cover portion 203 is configured to face away from the face of the person 100 as a user in the tied configuration and includes a front nose portion 202. The front nose portion 202 defines a front part of a nose pocket 204 in which a nosebridge 209 (FIG. 2) is disposed. The nose pocket 204 is disposed between the front cover portion 203 and the rear cover portion 205, and the nosebridge 209 is disposed within the nose pocket 204.

Referring to FIG. 2, the rear cover portion 205 of the protective mask 200 is configured to face toward the face of the person 100 in the tied configuration of FIG. 1. In FIG. 2, the protective mask 200 is shown in an open and loose configuration. The rear cover portion 205 defines a rear part of the nose pocket 204 in which the nosebridge 209 is disposed.

A periphery of the protective mask 200 is defined by a top boundary 206 and a bottom boundary 208. A center vertical axis 210 defines a center of the protective mask 200 such that features of the left-side of the protective mask 200 match those of the right side of the protective mask 200. The top boundary 206 defines a top portion of the nose pocket 204, which is defined at a bottom portion at a position above a horizontal longitudinal axis of the protective mask 200. Side portions 212 define side boundaries of the protective mask 200.

In an embodiment, the nosebridge 209 is disposed approximately 0.125 inches below the top boundary 206. The nosebridge 209 may be a rectangular shape including a length and a width. The length along a longitudinal axis perpendicular to the center vertical axis 210 may be approximately 7.500 inches. The width aligned with the center vertical axis 210 may be approximately 0.750 inches. A length of the protective mask 200 along the longitudinal axis may be about 32.996 inches. A width of the protective mask 200 along the center vertical axis 210 and between the top boundary 206 and the bottom boundary 208 may be about 9.065 inches.

The nosebridge 209 disposed in the nose pocket 204 may be made of a metal alloy, such as stainless steel, and may be encased with a component such as a cloth tape or other protective covering. The nosebridge 209 may be made of a flexible, bendable material configured to conform to a nose shape of a person. In embodiments, a protective padding material may be disposed on at least a portion of the nosebridge 209 and may be configured to protect against the nosebridge 209 from tearing out and through the material of the nose pocket 204. By way of example, and not as a limitation, the nosebridge 209 may be entirely wrapped by a protective padding material, and the protective padding material may comprise a duct tape type material. It is contemplated and within the scope of this disclosure that such embodiments of the nosebridge 209 may be utilized in one or more other nosebridges as described herein.

A protective strip 207 may be disposed on the nose pocket 204 on the rear cover portion 205 of the protective mask 200. The protective strip 207 may be configured to be disposed on the rear cover portion 205 along a length of the nosebridge 209 disposed within the nose pocket 204. The protective strip 207 is configured to protect the skin of the person 100 wearing the mask 200, such as along the nose 102 of the person 100. The protective strip 207 may be made of silicone or like materials configured to adhere to skin without causing abrasion. The adherence of the protective strip 207 of the protective mask 200 against the nose 102 of the person 100 is configured to prevent release of air particles and fogging of eyewear of the person 100 and/or to form a face seal.

The protective mask 200 is made of a material 214 configured to allow for comfort and durability and may be manufactured, woven, or assembled in a way to block a majority of aerosol particle transmissions. As non-limiting example, the material 214 may include a cotton material. The cotton material may include one or more layers of a non-allergenic component configured to prevent against skin breakout while filtering out contagion particles from breathable air. For example, the cotton material may include three layers. In an embodiment, the layers may individually or collectively provide cooling, allergen protection, and/or water resistance features. It is contemplated and within the scope of this disclosure that the cloth material of the protective masks described herein may be made of 100% cotton. In embodiments, the cotton may be lightweight, hypoallergenic organic cotton. The cloth material may be washable, reusable, sustainable, and configured to provide allergen protection (e.g., non-allergenic) with a filter. In embodiments, the materials may be a high performance allergen a viral protective cotton with a cooling technology and high performance, breathable filter up to 0.05 microns.

Figure 8:
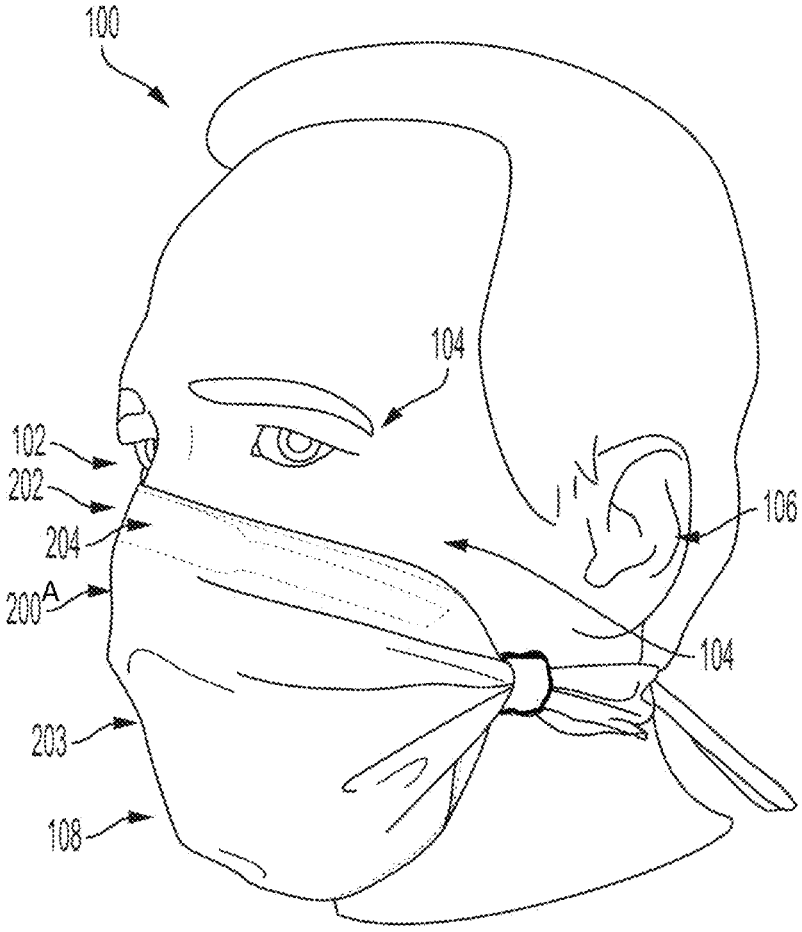
FIG. 8 schematically illustrates a perspective view of a person wearing a protective mask in another tied configuration, according to one or more embodiments shown and described herein.
Figure 9:
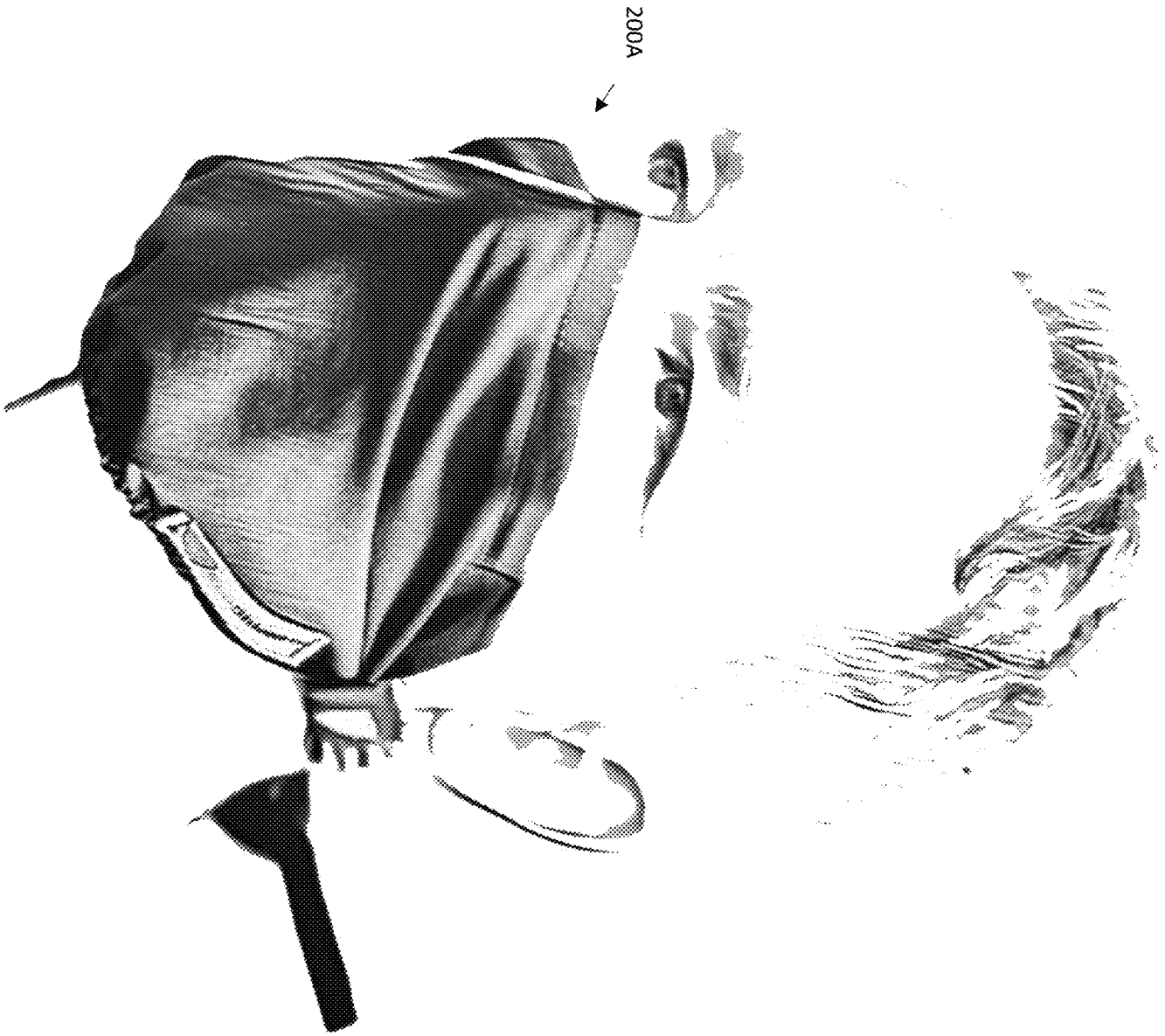
FIG. 9 schematically illustrates another perspective view of a person wearing a protective mask in the another tied configuration, according to one or more embodiments shown and described herein.
Figure 10:
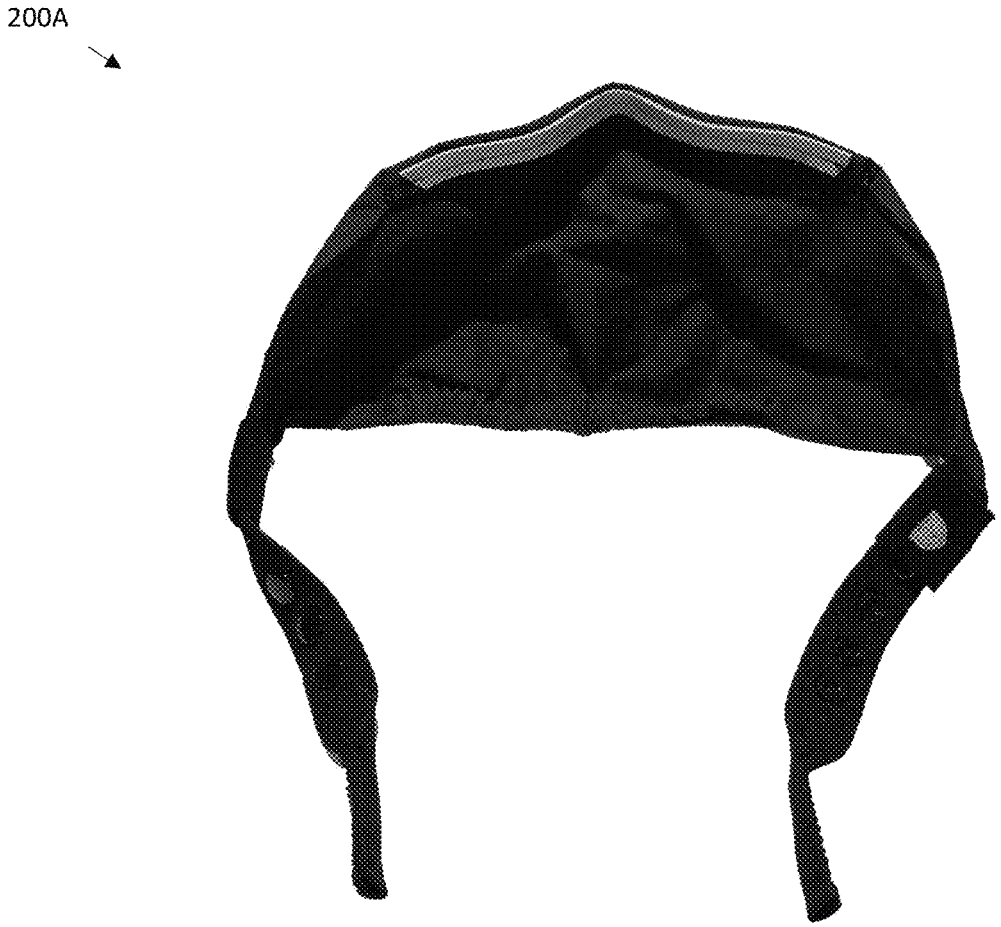
FIG. 10 schematically illustrates a rear view of the protective mask of FIG. 9 in an open and loose configuration (which may also be semi-opened in a gathered configuration that is gathered with an elastic band under the chin), according to one or more embodiments shown and described herein.

Referring to FIGS. 8-9, another embodiment of a protective mask 200A is shown in which the person 100 is wearing the protective mask 200A in another tied configuration, which may be semi-opened in a gathered configuration that is gathered with an elastic band under the chin. Referring to FIG. 10, a rear view of the protective mask 200A is shown. The protective mask 200A is similar to the protective masks 200, 300 described herein and is shown to describe other embodiments, such as use of an elastic band under the chin, an elastic slider or sliding band as a fastening mechanism for an adjustable fit, and/or use of a fastening material (such as VELCRO) affixed to an elastic neoprene. The elastic strip may be configured under a chin area to modify the fit by closing the protective mask to provide a protective configuration. The elastic sliding band may be placed on each side of the protective mask 200A to adjust the fitting of the protective mask 200A to the person 100. The at least one tie portion may further be configured to tie the protective mask 200A to the face of the user (e.g., the person 100) using a double toggle, a fastening material affixed to an elastic neoprene, or combinations thereof.

Figure 3:
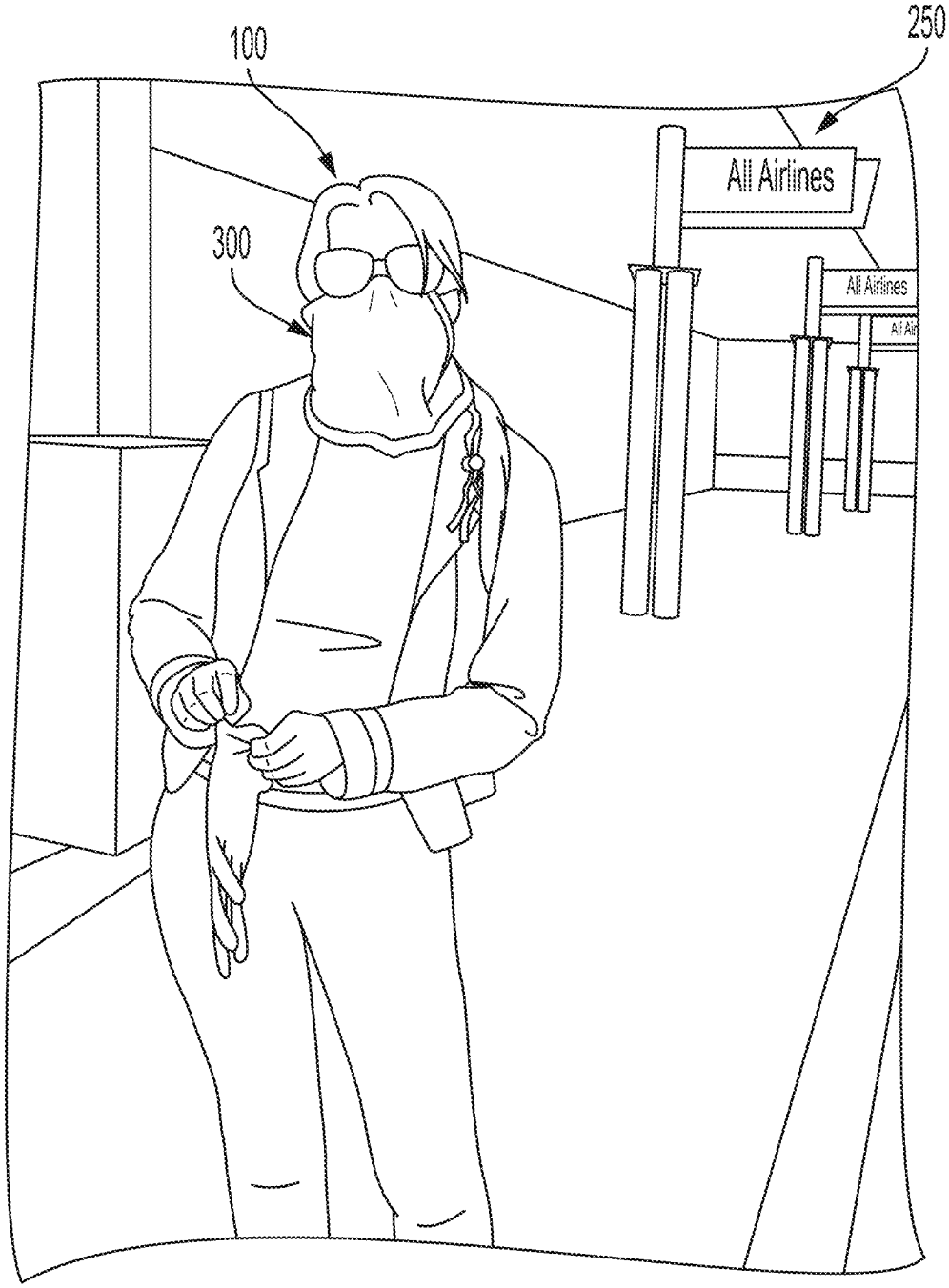
FIG. 3 schematically illustrates another perspective view of a person wearing a protective mask in a tied configuration, according to one or more embodiments shown and described herein.

Referring back to FIG. 3, in another embodiment, a protective mask 300 includes similar features of the protective mask 200 except with differences noted herein. The protective mask 300 is shown on a person 100 in an environment 250 in a tied configuration. The environment 250 may be, for example, an airport, a mall, a crowded venue, a medical setting such as a hospital, or other environment at which the person 100 is located and which includes a plurality of people.

Figure 4:
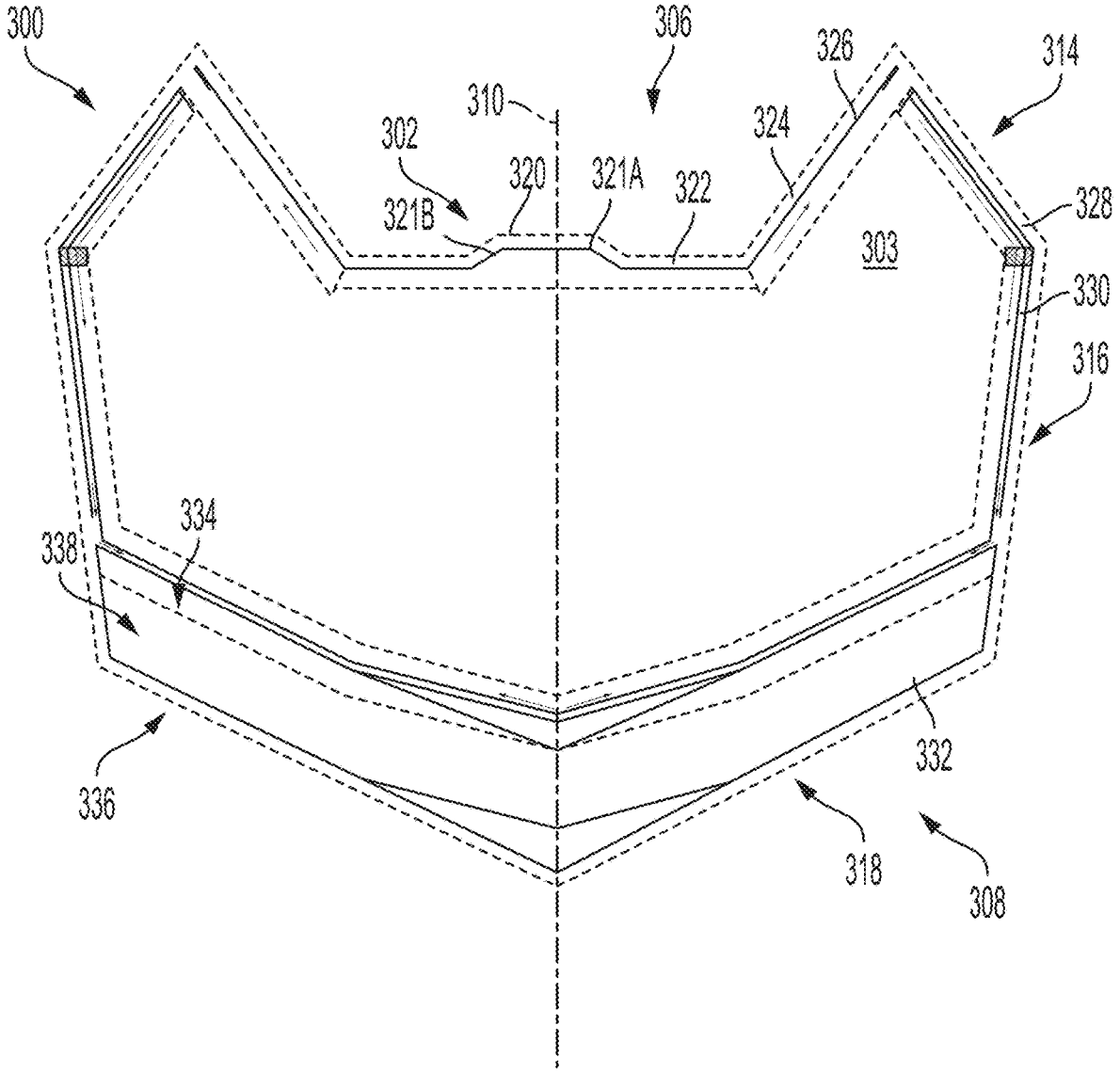
FIG. 4 schematically illustrates a front view of the protective mask of FIG. 3 in an open and loose configuration, according to one or more embodiments shown and described herein.

Referring to FIG. 4, a front cover portion 303 of the protective mask 300 is shown. The front cover portion 303 includes a front nose portion 302, a nosebridge 309 (FIG. 6) disposed in a nose pocket 304, a center vertical axis 310, a top boundary 306, a bottom boundary 308, and side boundaries 316. In embodiments, the nosebridge 309 may include a rectangular bottom and a top portion with an intermediate bump. As a non-limiting example, the top boundary 306 is configured to define a bump portion 320, dip walls 322, upward angled side walls 325 (FIG. 7) including bottom portion 324 and upper portion 326, and downward angled side walls 328. In embodiments, the nose pocket includes the bump portion 320 as a first bump portion along the top boundary 306, and the nosebridge 309 includes a second bump portion 360 (FIG. 7). The first bump portion 320 of the nose pocket is sized and shaped to house the second bump portion 360 of the nosebridge 309.

The dip walls 322 are configured to extend from bottom side ends of the bump portion 320 in opposite directions until ending at second side ends. Each upward angled side wall 325 is configured to extend upwardly at an angle with respect to the center vertical axis 310 and from the respective second end of the dip wall 322 until reaching a top point at an end of upper portion 326. From the top point of each upper portion 326 of each upward angled side wall 325, each downward angled side wall 328 is configured to downwardly extend at an angle with respect to the center vertical axis 310 until reaching an upper side point of the side boundaries 316. From the upper side point, a side boundary wall 330 is configured to extend at an inward tapered angle with respect to the center vertical axis 310 toward a bottom side point of the side boundaries 316. At the bottom side point of the side boundaries 316, a bottom wall 332 is configured to extend inwardly toward the center vertical axis 310 to define a chin boundary portion 318 of the bottom boundary 308.

The protective mask 300 may include a nose pocket in which a nosebridge 309 (FIG. 6) is disposed. The bump portion 320 is a part of the nose pocket and is configured to be disposed around to cover a bump portion of the nosebridge 309. Referring again to FIG. 4, collectively, the bump portion 320 and the dip walls 322 are configured to cover a portion of a nose 102 and nose side portions of the person 100. Further, each upward angled side wall 324 and respective downward angled side wall 328 are configured to define ear portions 314 to cover, as ear coverings, portions of a respective ear 106 of the person 100. In embodiments, when the ear portions 314 cover portions of the ears 106 of the person 100 in a tied configuration, the upward pull of the ear portions 314 on the protective mask 300 is countered by the bump portion 320 such a resulting downward pull on the nose area of the top boundary 306 causes the bump portion 320 to remain seated on a portion of the nose 102 of the person 100 in a sealed and tight fitting configuration. This sealed and tight fitting configuration is due to a light tension exerted by and seating of the bump portion 320 against the nose 102 of the person 100 in reaction to the upward pull of the ear portions 314 on the protective mask 300 in the tied configuration.

The bottom wall 332 further defines a bottom gutter boundary 336. A top gutter boundary 334 and the bottom gutter boundary 336 define a gutter 338 configured to define an aperture between the front cover portion 303 and the rear cover portion 305 (FIG. 6) within which a drawstring 348, 350 (FIG. 5) of tie portions 340 may be disposed (e.g., placed).

Figure 5:
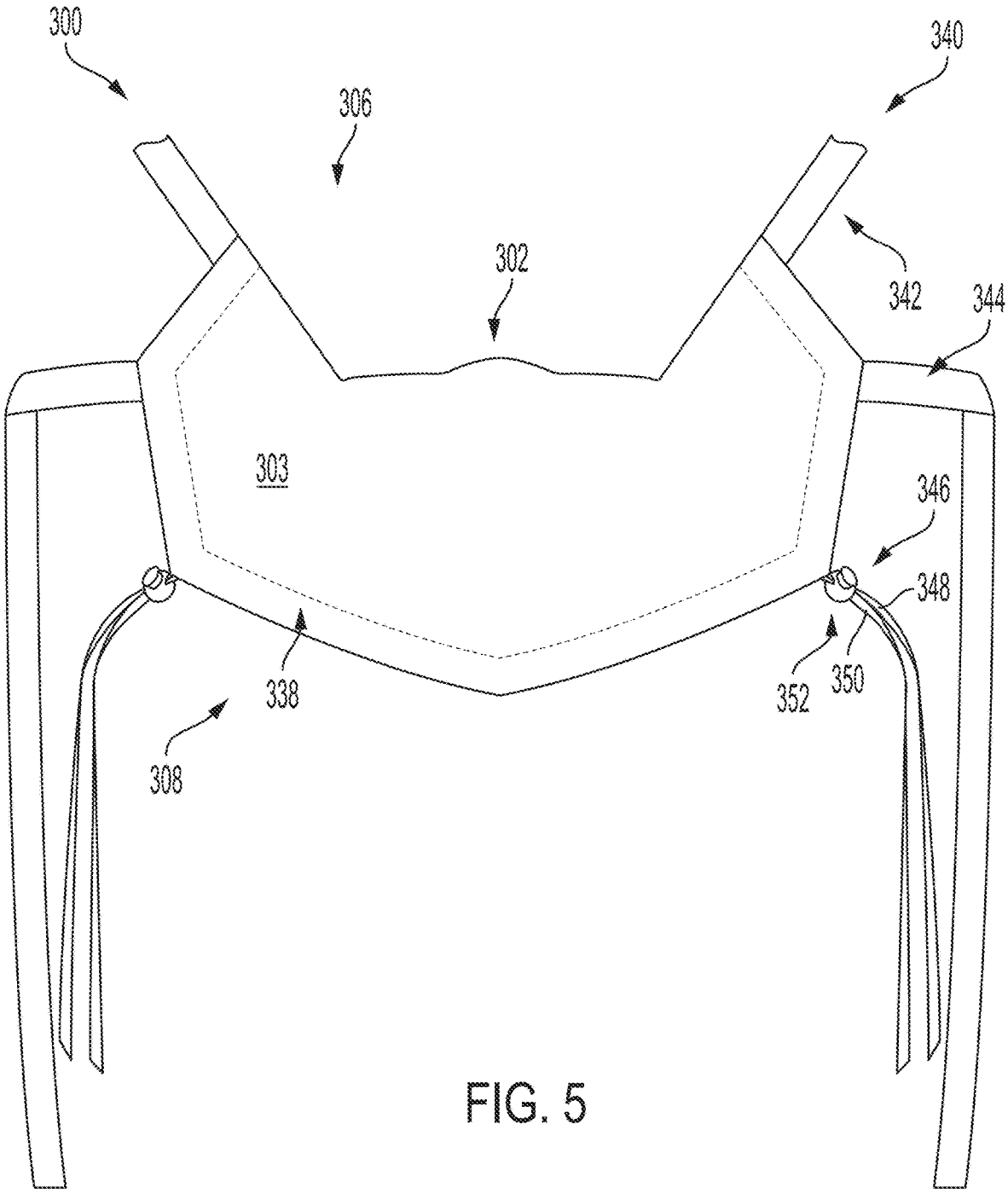
FIG. 5 schematically illustrates another front view of the protective mask of FIG. 3 in an open and loose configuration, according to one or more embodiments shown and described herein.

Referring to FIG. 5, the gutter 338 is disposed at least along the side boundaries 316 and the chin boundary portion 318 of the bottom boundary 308. A drawstring 348 may be disposed in the gutter 338 of each side boundary 316, and a drawstring 350 may be disposed in the gutter 338 of the chin boundary portion 318. The drawstrings 348, 350 may be configured to be drawn within and along the respective gutter 338 to tighten or loosen a fit of the bottom boundary 308 of the protective mask 300 again the cheek and chin features of face of the person 100.

In embodiments, the protective masks 200, 300 as described herein may include at least one tie portion configured to tie the protective mask to the face of the user (e.g., the person 100) in the tied configuration for an adjustable fit from an open and loose configuration. In embodiments, an elastic slider forward position or elastic slider back position may convert the protective masks 200, 300 from an open and loose configuration to a closed and taut configuration. As a non-limiting example, the protective mask 300 may include a plurality of tie portions 340. The tie portions 340 may include a top tie portion 342, a side tie portion 344, and a bottom tie portion 346 including the drawstrings 348, 350. The tie portions 340 include respective pair of ties of tie portions 342, 344, 346 configured to tie at a meeting point behind the head of a person in a tied configuration (e.g., including, but not limited to, fastening via toggles, neoprene, VELCRO, elastic, and snaps, or any combination thereof) of the protective mask 200. In embodiments, ends of the top tie portion 342 and the side tie portion 344 are fixed against the respective ear portions 314 and side boundaries 316 of the protective mask 300, such as in a sewn configuration. The drawstrings 348, 350 may be drawn along the gutter 338 to loosen or tighten and be clamped in a desired position by a common moveable clamp 352. Thus, in embodiments, the bottom tie portion 346 includes the pair of drawstrings 348, 350 as a first drawstring 348 and a second drawstring 350 coupled via the movable clamp 352. The bottom tie portion 346 may include the first drawstring 348 and the second drawstring 350 disposed in the gutter 338. The gutter 338 may be disposed between and defined by side boundary portions of the front cover portion 303 and the rear cover portion 305. The movable clamp 352 may be configured to couple the first drawstring 348 and the second drawstring 350 to tighten or loosen the first drawstring 348, the second drawstring 350, or combinations thereof.

Figure 6:
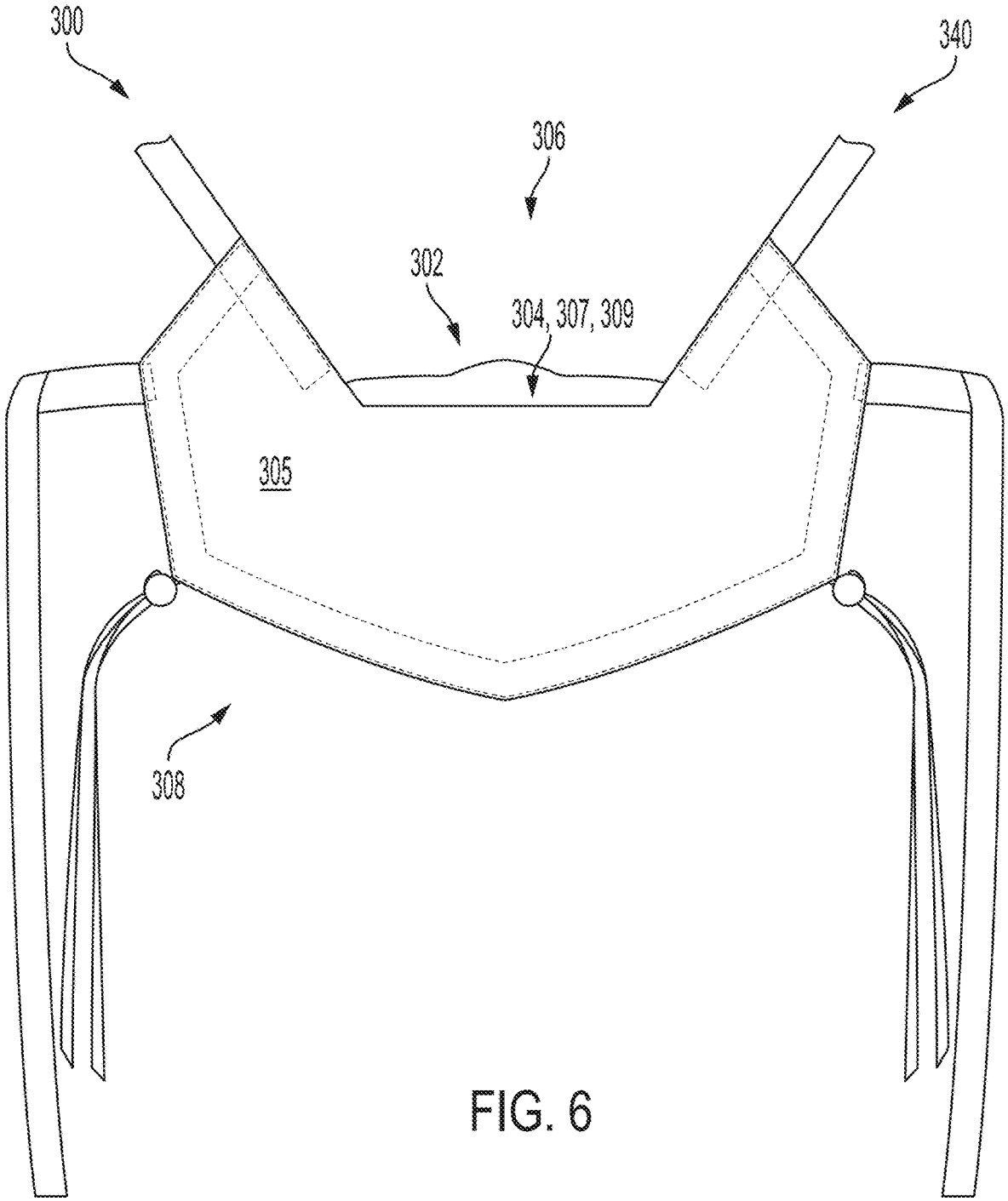
FIG. 6 schematically illustrates a rear view of the protective mask of FIG. 3 in an open and loose configuration, according to one or more embodiments shown and described herein.
Figure 7:
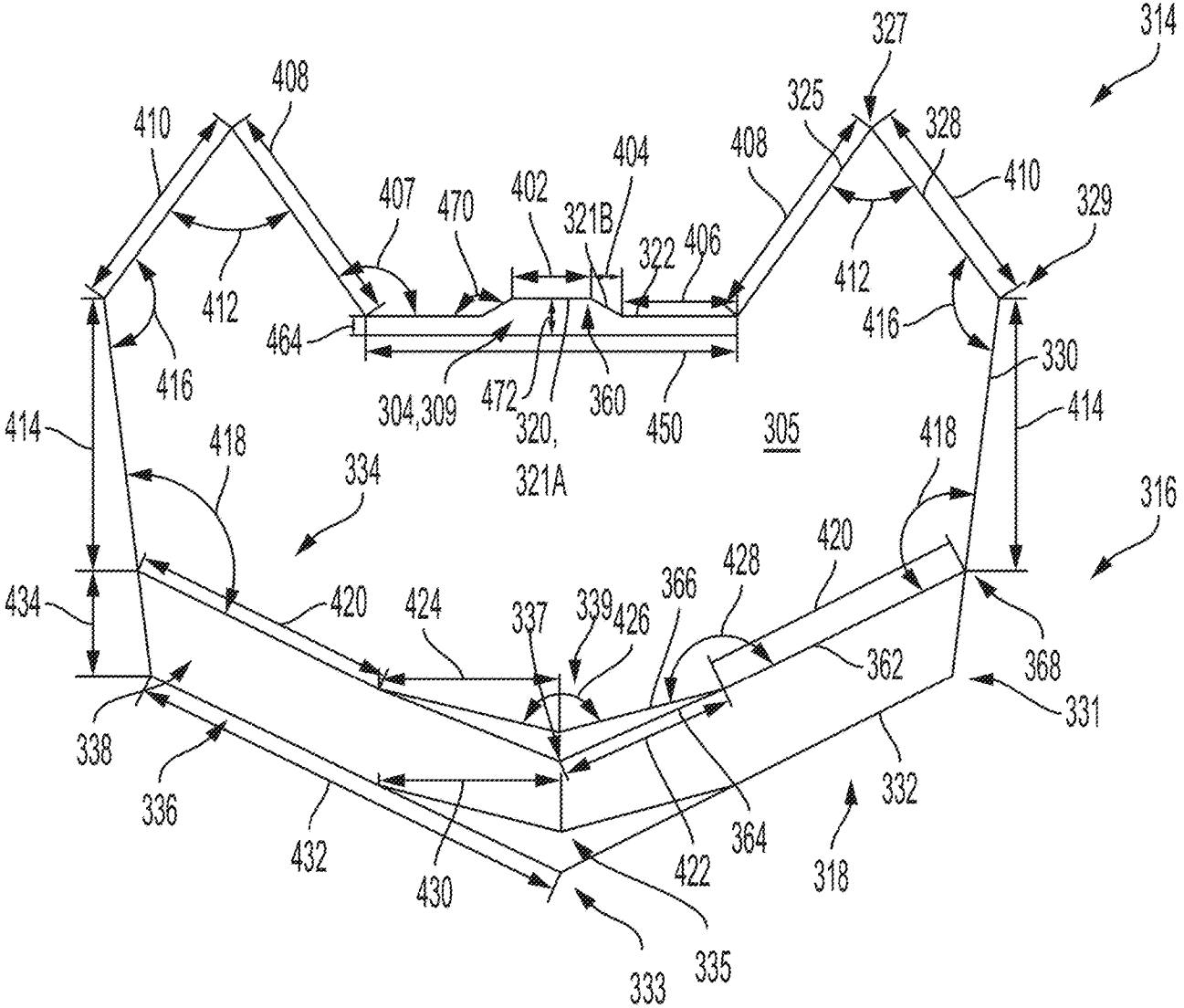
FIG. 7 schematically illustrates another front view of the protective mask of FIG. 3 in a mask cutout configuration for manufacturing, according to one or more embodiments shown and described herein.

Referring to FIG. 6, the rear cover portion 305 of the protective mask 300 may include a protective strip 307 disposed on the nose pocket covering of the nosebridge 309 to protect the skin of the person 100 wearing the mask 300. As described above, the adherence of the protective strip 307 of the protective mask 300 against the nose 102 of the person 100 is configured to prevent release of air particles and fogging of eyewear of the person 100.

A method of manufacturing a protective mask 200, 300 of FIGS. 1-6 may include preparing a nose pocket 204, 304 disposed between a front cover portion 203, 303 and a rear cover portion 205, 305 of the protective mask 200, 300, and disposing a nosebridge 209, 309 within the nose pocket 204, 304. The method may further include attaching a plurality of tie portions 340 to the protective mask, the plurality of tie portions 340 comprising a top tie portion 342, a side tie portion 344, and a bottom tie portion 346. The bottom tie portion 346 may include the pair of drawstrings 348, 350 coupled via the moveable clamp 352. Thus, in an embodiment, the protective mask 200, 300 may include three tie portions associated with four tie strings. Two tie strings may be fixed to associated tie portions 342 and 344 and may be configured to be disposed above and below ears of the person 100 in a tied configuration for increased comfort of wear. Two other tie stings may be adjustable as drawstrings 348, 350 of the bottom tie portion 346 disposed in a gutter 338 and may be adjustably clamped in a desire position via the moveable clamp 352. As described above, the gutter 338 may be disposed between and defined by side boundary portions (e.g., of side boundaries 316 and chin boundary portion 318) of the front cover portion 303 and the rear cover portion 305, and portions of the pair of drawstrings 348, 350 may be disposed within the gutter 338. Further, the first drawstring 348 and the second drawstring 350 may be coupled via the movable clamp 352, which is configured to tighten or loosen the first drawstring 348, the second drawstring 350, or combinations thereof (e.g., one or both of a pair of drawstrings 348, 350). It is contemplated and within the scope of this disclosure that the protective masks 200, 300 may include one or more gutters 338 at various positions along sides or other surfaces of the protective masks 200, 300. Within the one or more gutters 338, one or more drawstrings 348, 350 may be disposed to adjustable fit the protective mask 200, 300 to a face of the person 100 wearing the protective mask 200, 300 in a tied configuration. Thus, the protective masks described herein may include a series of gutters 388 and ties portions to secure and adjust fit around the head of a user, including but not limited to a side of the face, a top head portion, under the chin, or other areas of the user.

Ear coverings (e.g., ear portion 314) may be disposed on the protective masks 200, 300 configured to cover ears of a user as the person 100 in a tied configuration. Further, in some embodiments, the first bump portion 320 of the nose pocket 304 may be disposed along a top boundary 206, 306 of the protective mask 200, 300. The nosebridge 209, 309 may include a second bump portion 360, and the first bump portion 320 of the nose pocket 304 may be sized and shaped to house the second bump portion 360 of the nosebridge 209, 309.

In an embodiment, and referring to FIG. 4, a method of manufacture of the protective mask 300 as described herein may include attaching a rubber material to an outside lining at a top portion of a first side (e.g., front) of a mask cutout, flipping the mask cutout to a second side, attaching a metal to an inside lining at the top of the second side (e.g., rear, and as the nosebridge disposed in a pocket), straps may be sewn that are approximately 1.25 inches wide, sewing a top portion above the metal, snipping fabric at curves, and turning the mask cutout to the first side. The outside edges may be folded in 0.5 inches, and the seams may be ironed inwards. Side straps may added below ear portions on each side portion of the mask, and upward angled ear covering walls may be sewn on and folded 0.5 inches after and on top of side folds. Corners may be topstitched on both outer sides and at a bottom central chin portion. Draw straps may be added by tacking tops at upper corners at top points of the ear coverings. Topstitching may be performed around the outer edge from top to top to leave a center open to add draws (e.g., gutters). Such draws may be threaded in along the both outer sides and bottom chin portions. Four sleeves may be topstitched about 0.75 inches from the edge for the drawstrings, the bottom central chin portion may be topstitches, and dongles may be added. Such dongles may be USB verification devices corresponding to embroidery software to verify instructions to a sewing machine, for example.

Referring to FIGS. 4 and 7, a rear cover portion 305 of the protective mask 300 is shown. The rear cover portion 305 includes the nosebridge 309 (FIG. 6) disposed in the nose pocket 304, the top boundary 306, the bottom boundary 308, and side boundaries 316. The nosebridge 309 may include a length 450 and a width 646. The length 450 may be approximately 7.600 inches, and the width 464 may be approximately 0.375 inches.

The top boundary 306 is configured to define the bump portion 320 including a top wall 321A and angled side walls 321B, dip walls 322, upward angled side walls 325, top point 327, downward angled side walls 328, and upper side point 329. The top wall 321A may include a length 402 of approximately 1.625 inches, and the angled side walls 321B may include a length 404 of about 0.613 inches and may be angled at an angle 470 of approximately 147.4 degrees. A distance 472 between the top wall 321A and a bottom wall may be approximately 0.766 inches. In embodiments, the nose pocket 304 includes the bump portion 320 as the first bump portion 320 along the top boundary 306, and the nosebridge 309 includes the second bump portion 360. The first bump portion 320 of the nose pocket 304 is sized and shaped to house the second bump portion 360 of the nosebridge 309.

The dip walls 322 are configured to extend from bottom side ends of the bump portion 320 in opposite directions until ending at second side ends. The dip walls 322 may include a length 406. The length 406 may be approximately 2.375 inches. Each upward angled side wall 325 is configured to extend upwardly at an angle with respect to the center vertical axis 310 and from the respective second end of the dip wall 322 until reaching the top point 327 at an end of upper portion 326. The upward angled side wall 325 may include a length 408 of approximately 4.720 inches. An angle 407 may be disposed between the dip wall 322 and the upward angled side wall 325. The angle 407 may be approximately 125.7 degrees.

From the top point 327 of each upper portion 326 of each upward angled side wall 325, each downward angled side wall 328 is configured to downwardly extend at an angle with respect to the center vertical axis 310 until reaching an upper side point 329 of the side boundaries 316. The downward angled side wall 328 may include a length 410 of approximately 4.313 inches. An angle 412 may be disposed between the upward angled side wall 325 and the downward angled side wall 328. The angle 412 may be about 72.7 degrees.

From the upper side point 329, the side boundary wall 330 is configured to extend at an inward tapered angle with respect to the center vertical axis 310 toward a first bottom side point 368 and a second bottom side point 331 of the side boundaries 316. The side boundary wall 330 may include a length 414 of approximately 5.583 inches. A distance 434 between the first bottom side point 368 and the second bottom side point 331 may be approximately 2.129 inches. An angle 416 may be disposed between the downward angled side wall 328 and the side boundary wall 330. The angle 416 may be approximately 136.0 degrees.

At the first bottom side point 368 of the side boundaries 316, a bottom wall 362 is configured to extend inwardly toward the center vertical axis 310 until splitting into a lower wall 364 and an upper wall 366. A length 420 of the bottom wall 362 until the split may be approximately 5.438 inches. The lower wall 364 ends at a point 337, and the upper wall 366 ends at a point 339. The lower wall 364 may include a length 422 of approximately 3.689 inches, and the upper wall 366 may include a length 424 of approximately 3.770 inches. An angle 428 may be disposed between the bottom wall 362 and the upper wall 366. The angle 428 may be approximately 169.8 degrees. An angle 426 may be disposed between upper walls 366 about the point 339, and the angle 426 may be approximately 149.9 degrees.

At the second bottom side point 331 of the side boundaries 316, the bottom wall 332 is configured to extend inwardly toward the center vertical axis 310 to define a chin boundary portion 318 of the bottom boundary 308. The bottom wall 332 splits into a lower portion to end at a chin point 333 and an upper portion to end at a chin point 335. A distance 430 from the split to the center vertical axis 310 may be approximately 3.645 inches. An angle 418 may be disposed between the side boundary wall 330 and either of the bottom walls 332, 362. The angle 418 may be about 123.0 degrees. A total length 432 of the bottom wall 332 between the second bottom side point 331 and the chin point 333 may be approximately 9.315 inches.

In embodiments described herein, the protective masks are configured to provide increased breathability through adjustable fittings, provide increased sealing against a face of a person through said adjustable fittings, and/or provide comfortable protection against contagion transmission for the person 100 wearing the protective mask 200, 300.

The protective masks described herein may be manufactured as a kit or in singular form, may be manufactured in a plurality of colors, may come in a plurality of sizes such as small, medium, and large, and may be reusable. The protective masks may be machine washable, configured to filter airborne particles to provide protection from contagions such as virus particles and/or allergens, and may be worn in various adjustable fitting configurations in a comfortable manner to the user. The protective masks may be made of a cotton material, have water resistance, and/or have a high performance filter in one or more layers.

The protective masks described herein include a sealed, non-slip nosebridge barrier configured to reduce and/or eliminate fogging of eyewear by preventing leakage of air through the nosebridge barrier and configured to adhere to the skin of the user in a comfortable, non-abrasion manner to prevent slippage from the nose of the user. The nosebridge barrier may include a nose pocket sewn into the protective mask sized and shaped to house a nosebridge feature, which may be a metal, a silicone, and/or a blend of metal and silicone. In embodiments, the protective masks may include a plurality of tie portions for adjustable, fit, and comfort control by the user as described herein, such as through use of a movable clamp and drawstring disposed in a gutter and held in an adjustable position by the moveable clamp. The movable clamp may thus act as a toggle feature to adjust and clamp fit of the mask along with the drawstring and gutter features in a desired configuration. In embodiments, the moveable clamp may additionally be used with one or more slidable bands configured to slide along one or more tie portions and configured adjust fit of the protective mask against a user. The one or more slidable bands may be configured to be utilized without the moveable clamp in other embodiments. Another tie portion may include use of VELCRO affixed to an elastic neoprene to provide adjustable fit to the user. The protective masks may include ear, nose, and/or mouth protection through covering features to protect a user from contagions that may otherwise be absorbed by the user through such orifices and/or to protect others from contagions that may be emitted by the user. The protective masks may also include an enclosed elastic band in the bottom of the mask under the chin to provide more protective fitting for the user.

In embodiments, the protective masks 200, 200A, 300 may be sized based of the sizing chart of TABLE 1 below.

TABLE 1

| Size | Width (cm) | Length (cm) | Width (in) | Length (in) |
|---|---|---|---|---|
| Kids | 28-32 | 8-12 | 11-12.5 | 3-4.75 |
| S/M | 32.5-35 | 12-13.5 | 12.5-13.75 | 4.75-5.25 |
| L | 35-37 | 14-15.5 | 13.75-14.5 | 5.25-6 |
| XL | 37+ | 16+ | 14.5+ | 6+ |

In the sizing charge of TABLE 1, the measurements are shown in centimeters (cm) or inches (in). In an aspect, an extra 1 inch or 2.54 cm may be added to the length set forth in TABLE 1 if extra room may be desired. The width of the protective masks 200, 200A, 300 may be measured from an outer edge of an ear lobe of the person 100 to an outer edge of the other ear lobe. The length of the protective masks 200, 200A, 300 may be measured from a middle of the bridge of the nose of the person 100 to around the bottom of the chin, such as centrally between an outer chin point and a chin-undersurface/throat transition point.

It is noted that the terms "substantially" and "about" and "approximately" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A protective mask, comprising:

a front cover portion configured to face away from a face of a user in a tied configuration and comprising a first layer;

a rear cover portion configured to face toward the face of the user in the tied configuration, the rear cover portion comprising a second layer separate from and connected to the first layer;

a nose pocket disposed between the front cover portion and the rear cover portion, wherein the nose pocket comprises a first bump portion having a first shape coplanar with a top edge of the protective mask;

a nosebridge disposed within the nose pocket, wherein the nosebridge comprises a second bump portion having a second shape coplanar with the top edge of the protective mask, and the first bump portion of the nose pocket is sized and shaped to house the correspondingly shaped second bump portion of the nosebridge, wherein the first shape corresponds to the second shape; and a protective strip, wherein the protective strip is configured to be disposed on the rear cover portion along a length of the nosebridge disposed within the nose pocket.

2. The protective mask of claim 1, wherein the nosebridge is comprised of a metal alloy.

3. The protective mask of claim 1, wherein the nosebridge is comprised of stainless steel.

4. The protective mask of claim 1, wherein the protective strip is comprised of silicone, a cloth covering, or combinations thereof.

5. The protective mask of claim 1, wherein the protective mask further comprises a plurality of tie portions.

6. The protective mask of claim 5, wherein the plurality of tie portions comprise a top tie portion, a side tie portion, and a bottom tie portion.

7. The protective mask of claim 6, wherein the bottom tie portion comprises a pair of drawstrings coupled via a moveable clamp.

8. The protective mask of claim 1, further comprising a gutter disposed between and defined by side boundary portions of the front cover portion and the rear cover portion.

9. The protective mask of claim 8, further comprising a bottom tie portion, the bottom tie portion comprising a first drawstring and a second drawstring disposed in the gutter.

10. The protective mask of claim 9, further comprising a moveable clamp, the moveable clamp configured to couple the first drawstring and the second drawstring, the moveable clamp further configured to tighten or loosen the first drawstring, the second drawstring, or combinations thereof.

11. The protective mask of claim 1, wherein the protective mask further comprises ear coverings.

12. A protective mask, comprising:

a front cover portion configured to face away from a face of a user in a tied configuration and comprising a first layer;

a rear cover portion configured to face toward the face of the user in the tied configuration, the rear cover portion comprising a second layer separate from and connected to the first layer;

a nose pocket disposed between the front cover portion and the rear cover portion, wherein the nose pocket comprises a first bump portion having a first shape coplanar with a top edge of the protective mask;

a nosebridge disposed within the nose pocket, wherein the nosebridge comprises a second bump portion having a second shape coplanar with the top edge of the protective mask, and the first bump portion of the nose pocket is sized and shaped to house the correspondingly shaped second bump portion of the nosebridge, wherein the first shape corresponds to the second shape;

a protective strip, wherein the protective strip is configured to be disposed on the rear cover portion along a length of the nosebridge disposed within the nose pocket; and at least one tie portion configured to tie the protective mask to the face of the user in the tied configuration.

13. The protective mask of claim 12, further comprising:

an elastic sliding band on each side to adjust the fitting of the mask;

an elastic strip configured under a chin area to modify the fit by closing the protective mask to provide a protective configuration;

the at least one tie portion further configured to tie the protective mask to the face of the user using a double toggle, a fastening material affixed to an elastic neoprene, or combinations thereof.

14. A method of manufacturing a protective mask, comprising:

preparing a nose pocket disposed between a front cover portion and comprising a first layer and a rear cover portion comprising a second layer separate from and connected to the first layer of the protective mask, wherein the nose pocket comprises a first bump portion having a first shape coplanar with a top edge of the protective mask;

disposing a nosebridge within the nose pocket, wherein the nosebridge comprises a second bump portion having a second shape coplanar with the top edge of the protective mask;

disposing the first bump portion of the nose pocket coplanar with the top edge of the protective mask, wherein the first bump portion of the nose pocket is sized and shaped to house the correspondingly shaped second bump portion of the nosebridge, wherein the first shape corresponds to the second shape; and disposing a protective strip on the rear cover portion along a length of the nosebridge disposed within the nose pocket.

15. The method of claim 14, further comprising attaching a plurality of tie portions to the protective mask, the plurality of tie portions comprising a top tie portion, a side tie portion, and a bottom tie portion, the bottom tie portion comprising a pair of drawstrings for coupling via a moveable clamp.

16. The method of claim 15, further comprising:

disposing a gutter between and defined by side boundary portions of the front cover portion and the rear cover portion, and disposing portions of the pair of drawstrings within the gutter; and coupling the pair of drawstrings via the movable clamp, wherein the moveable clamp is configured to tighten or loosen one or both of the pair of drawstrings.

17. The method of claim 14, further comprising:

disposing ear coverings on the protective mask configured to cover ears of a user in a tied configuration.

18. The protective mask of claim 1, wherein in the tied configuration, a resulting downward pull on a nose area of the top edge of the protective mask causes the first bump portion of the nose pocket and the second bump portion of the nosebridge disposed therein to remain seated on a portion of a nose on the face of the user in a sealed and tight fitting configuration.

19. The protective mask of claim 18, further comprising ear coverings, wherein in the tied configuration, the ear coverings cover portions of ears of the user and a resulting upward pull of the ear coverings are countered by the resulting downward pull on the nose area of the top edge of the protective mask by the first bump portion of the nose pocket and the second bump portion of the nosebridge disposed therein due to an exerted resulting tension.

* * * * *